US007506582B2

(12) United States Patent
Petersen

(10) Patent No.: US 7,506,582 B2
(45) Date of Patent: Mar. 24, 2009

(54) HAND STAMP WITH ADHESIVELY HELD INK CARTRIDGE

(76) Inventor: Craig J. Petersen, 410 Meacham, Park Ridge, IL (US) 60068

( * ) Notice: Subject to any disclaimer, the term of this patent is extended or adjusted under 35 U.S.C. 154(b) by 332 days.

(21) Appl. No.: 11/375,724

(22) Filed: Mar. 15, 2006

(65) Prior Publication Data

US 2006/0174787 A1 Aug. 10, 2006

Related U.S. Application Data

(63) Continuation-in-part of application No. 10/769,641, filed on Jan. 30, 2004, now Pat. No. 7,073,437.

(51) Int. Cl.
*B41K 1/42* (2006.01)

(52) U.S. Cl. ..... 101/333; 101/401.1; 101/405

(58) Field of Classification Search ..... None
See application file for complete search history.

(56) References Cited

U.S. PATENT DOCUMENTS 3,172,356 A * 3/1965 Vosburg ..... 101/125
3,277,819 A * 10/1966 Berkland ..... 101/125
3,335,660 A * 8/1967 Vosburg ..... 101/125
3,832,947 A * 9/1974 Funahashi ..... 101/327
4,306,498 A * 12/1981 Fujimura ..... 101/333
5,285,725 A * 2/1994 Imamaki et al. ..... 101/127.1
5,303,647 A * 4/1994 Seo et al. ..... 101/125
5,577,444 A * 11/1996 Toyama ..... 101/379
5,899,142 A * 5/1999 Suda et al. ..... 101/125
5,979,323 A * 11/1999 Hirano ..... 101/401.1
5,996,493 A * 12/1999 Okumura et al. ..... 101/333
6,164,202 A * 12/2000 Takami ..... 101/405
6,189,450 B1 * 2/2001 Shih ..... 101/327
6,739,255 B2 * 5/2004 Blees et al. ..... 101/327

* cited by examiner

*Primary Examiner*—Jill E. Culler
(74) *Attorney, Agent, or Firm*—Knechtel, Demeur & Samlan

(57) ABSTRACT

A hand stamp that has a frame member that holds an ink cartridge. The cartridge has an ink storage layer and an image forming layer. An upstanding wall surrounds the ink storage layer forming an ink reservoir. There is a ledge surrounding the inside of the stamp frame that has an adhesive applied to it. The top of the upstanding wall on the ink storage layer is attached to the frame member by the adhesive. There is an ink impervious coating applied to the top of the upstanding wall where the ink cartridge attaches to the stamp frame so that the bond between the ink cartridge and frame is not compromised.

19 Claims, 3 Drawing Sheets

HAND STAMP WITH ADHESIVELY HELD INK CARTRIDGE

RELATED APPLICATION

This application is a continuation in part of U.S. patent application Ser. No. 10/769,641 filed Jan. 30, 2004 now U.S. Pat. No. 7,073,437.

BACKGROUND AND SUMMARY OF THE INVENTION

This invention relates to hand stamps and more particularly to a self-inking hand stamp that does not require a stamp pad. The hand stamp utilizes a porous foam layer and an ink cartridge mounted together in intimate contact with each other to create the printing aspect of the device. The porous foam layer has the image forming stamp material on its surface. This invention also relates to the design and manufacture of the stamp frame that adhesively holds the porous foam layer and ink cartridge to the stamp frame.

Many conventional stamps require manufacturing the printing surface from rubber or other flexible material. The printing surface is securely mounted on a handle that is grasped by the user. The printing surface is placed into contact with an inkpad where ink transfers to the printing surface. The inked printing surface is then pressed against the surface onto which the stamp image is to be transferred. Repetition of the stamping process requires that the printing surface be pressed against the inkpad each time an image is to be transferred. This is a disadvantage to the user as it requires extra time for each re-inking step and slows down the stamping process if multiple stampings are to be done. It also requires the use of a separate inkpad that must be periodically re-inked.

An improved stamp was developed that uses a printing surface made from an ink permeable material that allows ink to pass from an ink reservoir, through the printing surface and onto the object being marked. This eliminated the need for a separate stamp inkpad. These stamps are referred to as hand stamps. There is no simpler stamping device to transfer images than the hand stamp.

An example of this stamp is illustrated in U.S. Pat. No. 5,577,444 issued to Toyama. This patent illustrates a hand stamp that has a sealed ink compartment that stores the ink. The ink can be refilled into the compartment by means of removing a threaded screw at the top of the compartment. Once the screw is removed, the ink can be injected, and the screw replaced. The stamping member has a stamping surface with stamping and non-stamping portions. The stamp pad is fixed to the stamp frame at the factory and is not designed to be field installed or removed.

There are several problems with this device. First, the porous foam or printing surface is factory sealed. If an error is made during manufacturing, the entire mount must be thrown away, thus increasing costs. Since it is factory sealed, a special machine is required to expose the porous foam to form the image on the porous foam surface.

Another type of stamp is illustrated in U.S. Pat. No. 5,942,312 issued to Venkataraman et al. This patent discloses a pre-inked thermoplastic foam which has open cells in the area that is designed to transfer ink and closed or sealed cells in the area which is designed to be impermeable to ink. The pre-inked thermoplastic foam is pre-inked before the image is formed on the thermoplastic material. Thus if there is a problem with the image, the entire pad including the ink, is wasted. Furthermore there may be difficulties in forming an image on a pre-inked thermoplastic foam as it may be messy or require special handling due to the ink in the pre-inked thermoplastic foam. The pre-inked thermoplastic foam is mechanically held to the stamp and assembled at the factory. The pre-inked thermoplastic foam is not designed to be installed or removed in the field.

U.S. Pat. No. 5,996,493 issued to Okumura et al. illustrates a pre-inked stamp that uses an ink pack to supply ink to the porous stamp. The ink pack ruptures when the ink pack is pressed against a cutting device in the stamp. There is a transparent film thermally attached to the stamp surface to protect the stamp surface during transport and storage. The transparent film is removed just before using the stamp for printing images. The porous stamp portion is thermally attached to the holder at the factory and is not designed to be installed in the field.

Another stamp is disclosed in U.S. Pat. No. 6,164,202 issued to Takami. This patent discloses a stamp unit comprising a holder, which is placed in a stamp manufacturing device for making a stamping surface on a stamp material. The holder interacts with the stamp manufacturing device to properly position the holder in the manufacturing device. An image is formed on the surface of the stamp forming material by fusing portions on the surface. The stamp forming material is saturated with ink and ink is allowed to flow out from the non fused portions onto a printing sheet forming the image.

A problem not solved by the prior art devices is providing an ink cartridge and stamp in a self contained easy to use unit. Also, the method of manufacturing a hand stamp with an adhesively held ink cartridge was never taught.

A characteristics of the prior art devices is that the stamp forming material with the image to be transferred thereon was held in place in the stamp by means of a trim ring or other mechanical grasping means that generally extended around the circumference of the stamp forming material. When the stamp is assembled, the trim ring snaps into place holding the stamp forming material within the stamp frame. In other devices the stamp forming material is attached to the stamp frame at the factory in such a way that it could not be attached in the field. It would be desirable if the stamp forming material could be held in place by adhesive, thus eliminating one component of the stamp. This would also reduce the cost of the stamp. It would also be desirable if the attachment of the stamp pad to the frame could be done in the field so that expensive equipment and added manufacturing costs could be eliminated.

Applicant's invention addresses and solves the problems of the prior art devices. The invention comprises an ink cartridge that has an ink storage layer or cartridge and a porous foam layer with an image forming stamp material on the surface. The two layers are in intimate contact with each other and are designed for mounting in a hand stamp. The hand stamp has a handle, which is grasped by the user. The image forming stamp material is a porous foam material and has an outer surface made of a porous resin layer. Portions of the porous resin layer are melted and solidify into impermeable areas that are ink impermeable, and other portions of the porous resin layer remain unmelted and allow ink to pass. In this manner the stamping image is defined. There is an upstanding wall or window frame that surrounds the cartridge. This provides an ink reservoir or ink well where ink is poured to saturate the cartridge. The top edge of the upstanding wall is coated with an ink impermeable coating for providing a surface that is receptive to an adhesive placed on it.

A frame member has a top, a bottom and side walls. There is a ledge at the bottom. An adhesive is applied between the ledge and the top edge of the upstanding wall on the cartridge. The ink cartridge is thus affixed to the ledge by means of the adhesive. The coating on the top edge provides a surface that maintains the adhesion between the cartridge and the ledge as it is impervious to the ink.

OBJECTS AND ADVANTAGES

It is an object to provide a hand stamp that uses an ink cartridge that has an upstanding wall surrounding the cartridge with an ink impervious coating on the top edge of the wall for providing an ink free surface on the ink cartridge for attaching to the stamp frame. It is a related object to provide an adhesive layer between the ink free surface on the upstanding wall and the stamp frame for attaching the cartridge to a ledge on a frame member.

An advantage of this invention is that it allows the ink cartridge to be affixed to the frame member by means of adhesive instead of the traditional retaining or trim ring. This eliminates one of the parts of previous stamps resulting in lower cost and ease of manufacturing and assembling the stamp. This also eliminates the need for factory sealing the ink cartridge or ink storage reservoir.

Another advantage of this invention is that the interface between the ink cartridge and the stamp frame does not degrade over time so that the cartridge remains attached to the frame. Another advantage is that the interface between the ink cartridge and the stamp frame does not become saturated with ink so that the adhesive bonding between the cartridge and frame does not fail.

These and other objects and advantages will be apparent from reviewing the following Description of the Drawings and Description of the Preferred Embodiment.

DESCRIPTION OF THE PREFERRED EMBODIMENT

Figure 1:
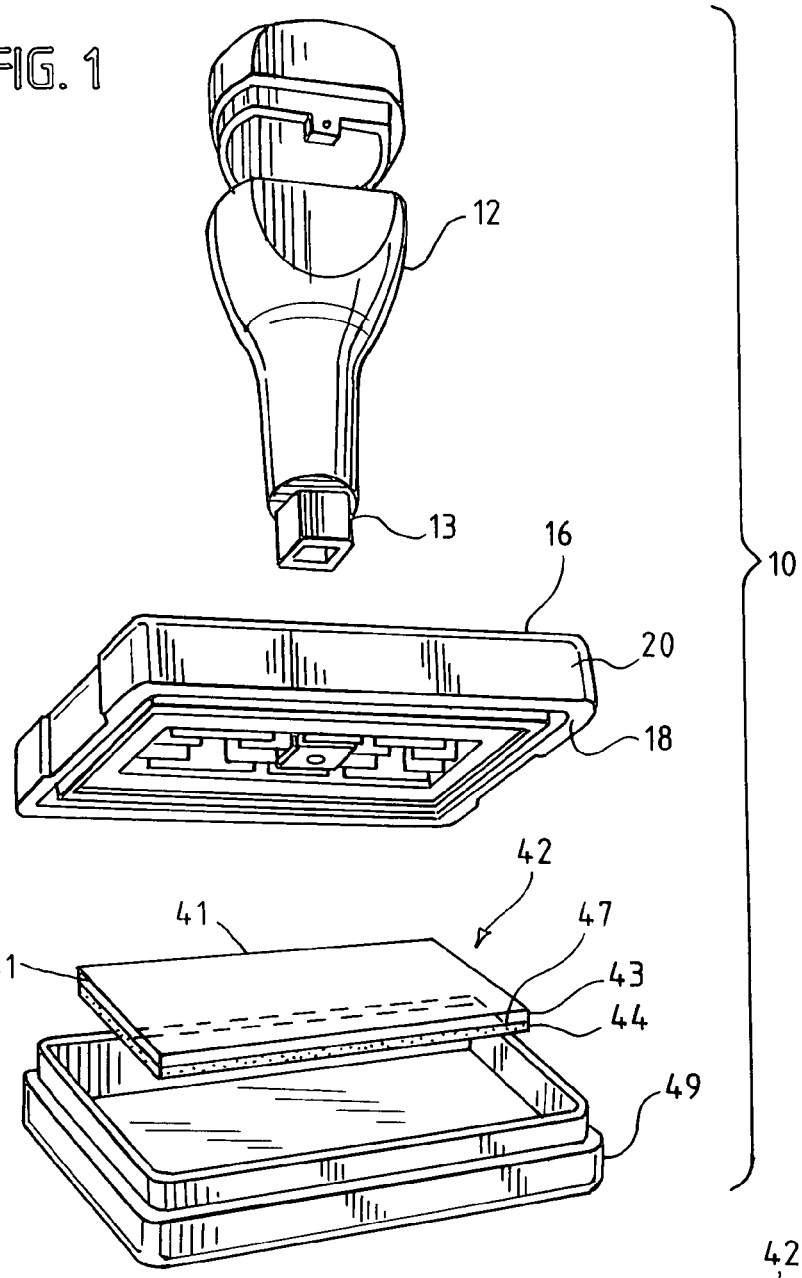
FIG. 1 is an exploded perspective view of a hand stamp illustrating the orientation of the various parts of the stamp and the inventive frame member.

Turning to FIG. 1 there is illustrated a hand stamp 10, which utilizes the present invention. The stamp 10 does not require the use of a separate, stand alone inkpad that is not a part of the hand stamp 10. There is a handle 12 designed to be grasped by the user. There is a square base 13 at a bottom portion of the handle 12.

Figure 4:
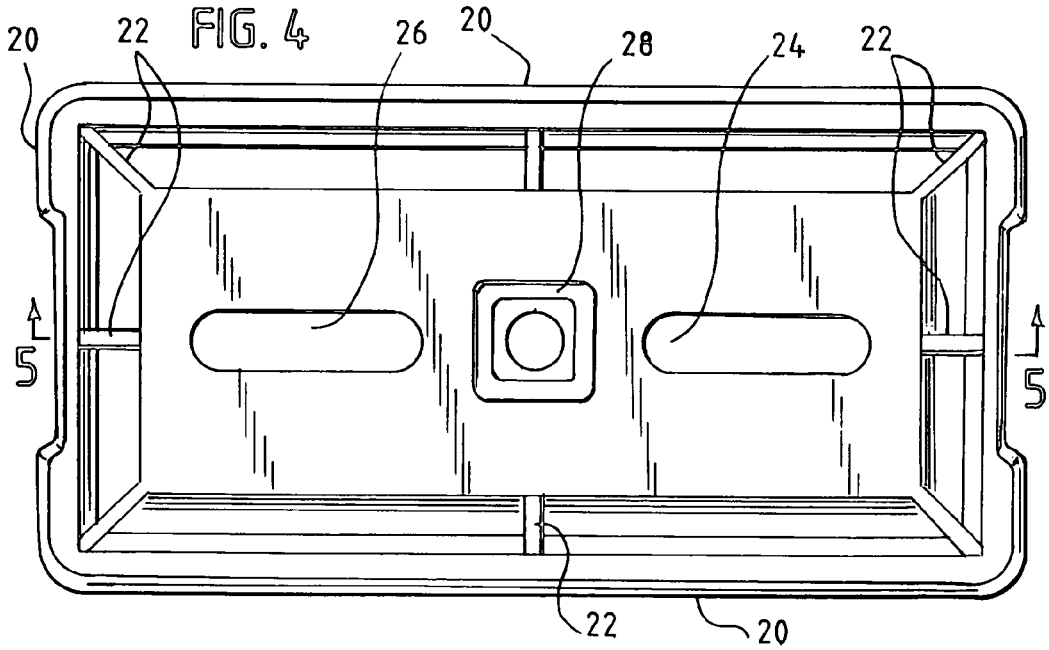
FIG. 4 is a top view of the frame member.

A frame member 14 has a top 16, a bottom 18, and side walls 20 that enclose a frame cavity 21. The frame member 14 is illustrated as rectangular as this is the most common stamp configuration, although other geometric shapes such as square or circular can also be used. As seen in FIG. 4 the frame member 14 has support ribs 22 that provide structural support by joining the top 16 to the side walls 20. There is a square receiving hole 28 centrally disposed in the frame member 14 which receives in frictional engagement the square base 13 of the handle 12. This joins the handle 12 to the frame member 14. There are ink receiving holes 24, 26 through which ink is poured as will be described later.

Figure 3:
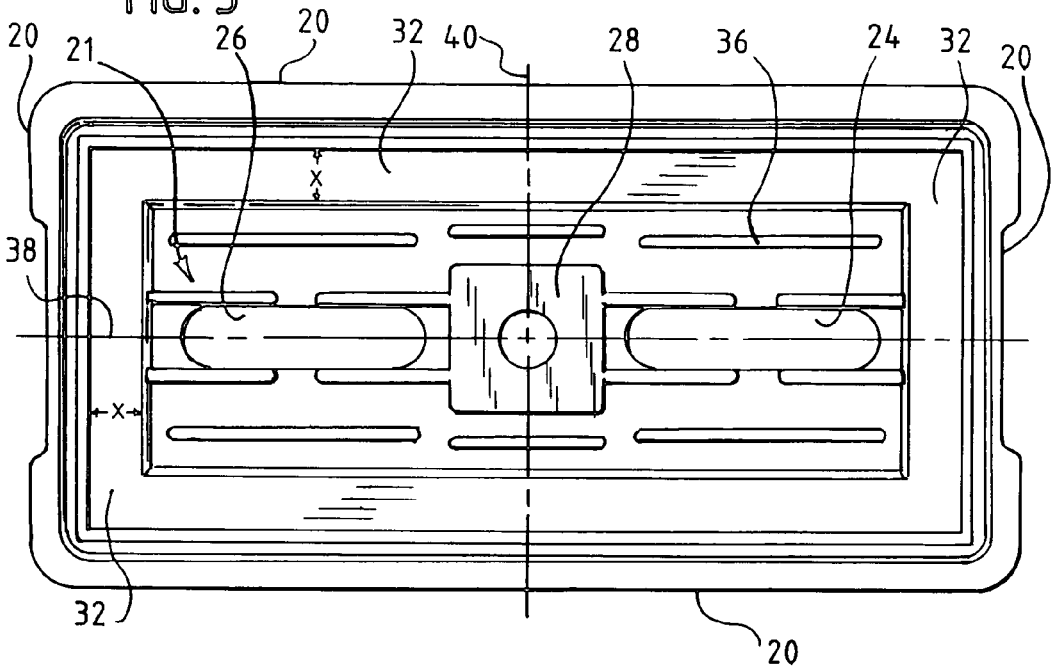
FIG. 3 is a bottom view of the frame member illustrating the ledge and baffle members.

The bottom 18 of the frame member 14 is illustrated in FIG. 3. There is a ledge 32 that extends around the entire perimeter of the frame member 14 inside of the frame cavity 21. The ledge 32 extends a distance "x" from the side walls toward the centrally disposed receiving hole 28. An adhesive 34 is applied to the ledge 32 and covered with a removable covering (not illustrated). Alternatively a double sided tape is applied to the ledge with one side of the tape exposed and affixed to the ledge 32 and the other side of the tape left covered until ready for use. Another alternative is applying liquid glue to the ledge 32.

Optionally, a plurality of baffle members or plates 36 may be provided which are mounted inside of the frame cavity 21. The baffle members 36 extend vertically downward from the top 16 to a point above the bottom 18. The baffle members 36 are symmetrical about a horizontal center line 38 and vertical center line 40, both shown in phantom.

As seen in FIG. 1 there is an ink cartridge 42 with an outer edge 41 surrounding it. The ink cartridge 42 is comprised of an ink storage layer 43 and image forming layer 44 that has an image surface 46. This is the printing side or stamp surface. There is also an opposite non-printing side 47 that is in intimate contact with the ink storage layer 43. The image forming layer 44 is made from a porous soft resin in which optical energy absorbing material is dispersed. To produce an image 45 onto the image surface 46, a transparent film having the positive image to be created is placed against the image surface 46. The image is normally comprised of black and clear areas. With the transparent film with the image thereon against the image surface 46, the ink cartridge 42 is placed in a sealed light box with the image surface 46 pressed against a clear glass or plastic member. A xenon light is placed in the light box below the image surface 46 and energized for a predetermined time. The rays from the xenon light irradiate the image surface 46 through the transparent film wherever there were clear image areas. This causes a chemical reaction fusing the foam from the heat. This seals what were the clear areas resulting in areas that are non-permeable to the ink passing through the image forming layer 44. The rays do not penetrate the black image areas on the film and thus no reaction occurs on the image surface 46. These areas remain unsealed and thus ink permeable. Thus, the image 45 is formed. Machinery for this stamp forming process is available in the industry. Other methods to form the image 45 on the image forming layer 44 are available which provide ink permeable and ink impermeable areas to define the image.

The stamp 10 when completely assembled has a bottom cover 49 that snaps onto the bottom of the frame member 14. This covers the image forming layer 44 so that the image or ink is not accidentally transferred to surfaces or objects that are not intended to receive the image. The cover 49 is snapped off and exposes the image surface 46 when the stamp 10 is to be used.

Figure 2:
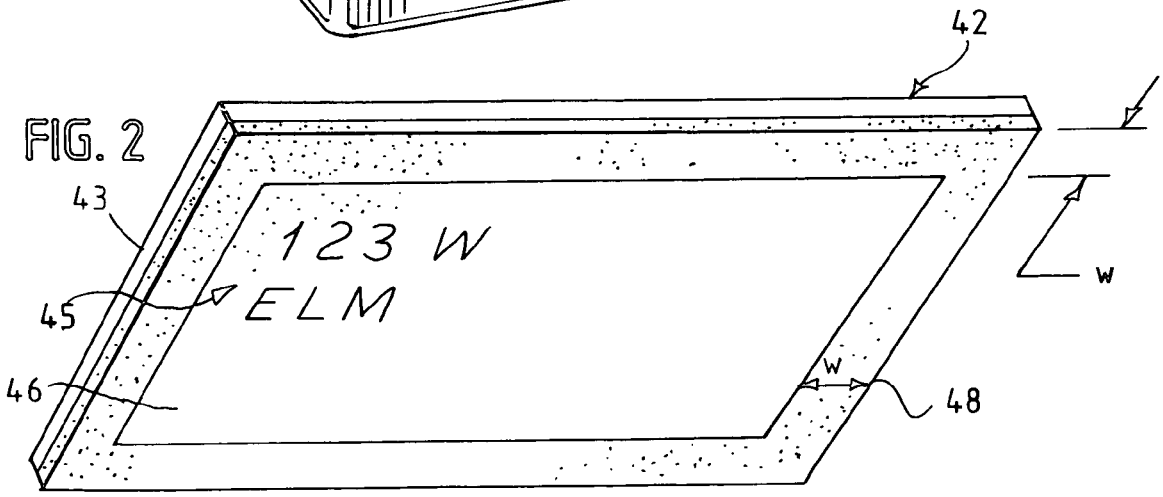
FIG. 2 is a bottom perspective view of the ink cartridge showing the image forming layer with an image thereon.

As seen in FIG. 2, the image forming layer 44 has the image 45 formed thereon as previously described. The image can be alpha-numeric designators, pictures, graphs, etc. There is a border area 48 that frames the image forming layer 44. None of the image 45 is intended to be in the border area 48. In fact, the border area 48 is preferably intended to not have any ink in this area. A width "w" of the border area 48 is substantially the same as the width "x" of the ledge 32.

Figure 5:
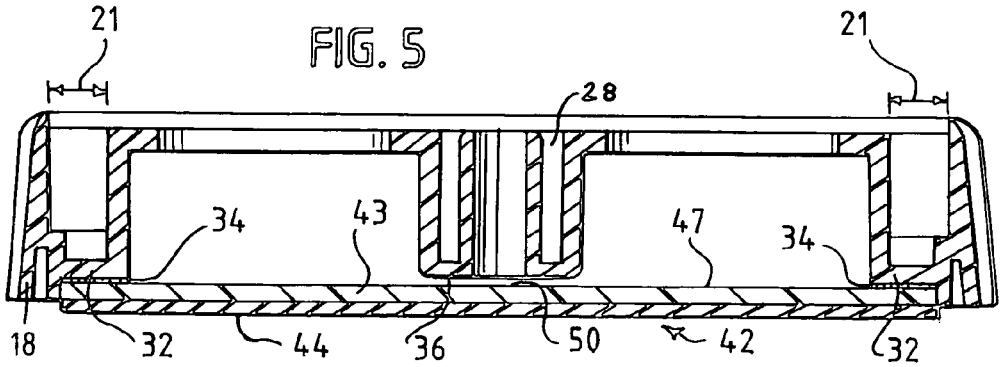
FIG. 5 is an enlarged cross sectional view with portions removed of the assembled frame member and ink cartridge.
Figure 6:
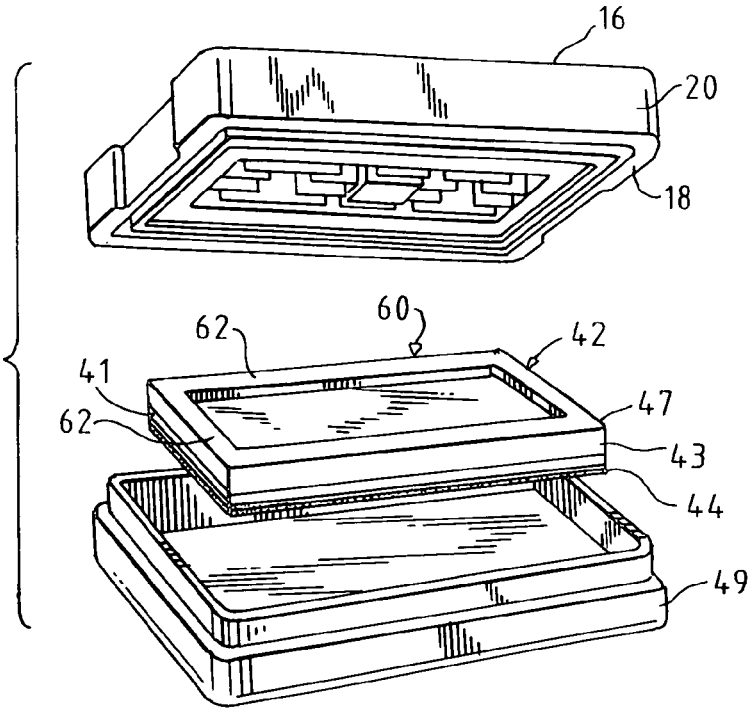
FIG. 6 is an exploded perspective view with portions removed of an alternative embodiment of a hand stamp illustrating the inventive ink cartridge and frame member.
Figure 7:
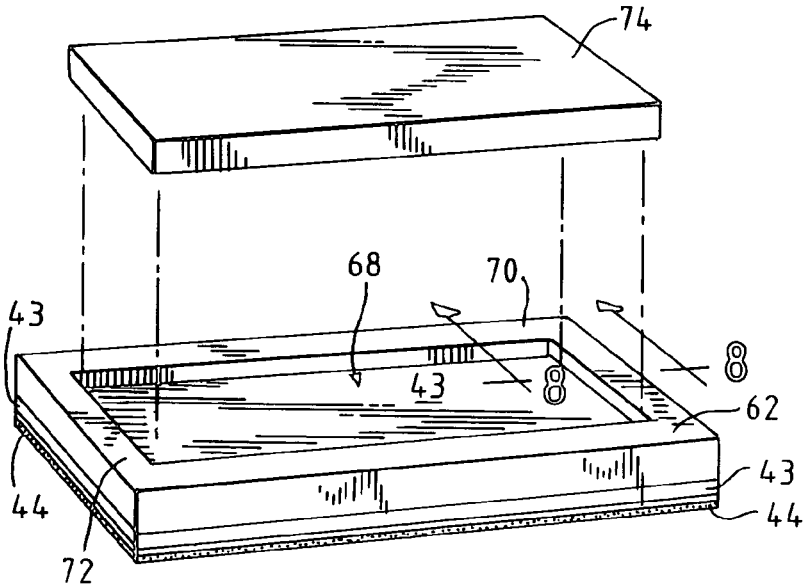
FIG. 7 is an exploded perspective view of the alternative embodiment of the ink cartridge.
Figure 8:
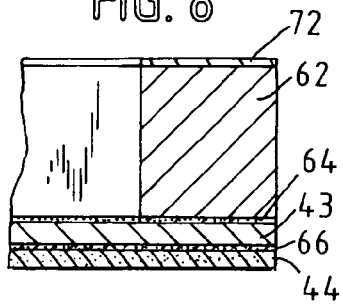
FIG. 8 is a cross section view taken along line 8-8 of FIG. 7 showing the various layers of the ink cartridge and image forming layer.

As seen in FIG. 5, the ink cartridge 42 has the border area 48 on its ink storage layer 43. The ink storage layer 43 is attached to the ledge 32 by means of the adhesive 34. In this manner the ledge 32 supports the edges of the ink cartridge 42. The ink cartridge 42 is dimensioned so that it is snugly received within the perimeter of the ledge 32 with the image forming layer 44 extending slightly below the bottom 18. This allows the image forming layer 44 to be retained within the frame member 14 yet allows the image forming layer 44 to extend below the bottom 18 of the frame member 14 for printing.

In the first embodiment illustrated in FIGS. 1-5, once the image is formed on the image forming layer 44 and the ink cartridge 42 is securely attached to the ledge 32, the ink cartridge 42 is loaded with ink. This is done by the user pouring, injecting or dripping a predetermined quantity of printing ink through the ink receiving holes 24, 26, onto the storage layer 43. The baffles 36 have their bottoms slightly above the ink storage layer 43. The ink flows between a gap 50 defined by the bottoms of the baffles and the top of the ink storage layer 43. Ideally the ink will saturate the ink storage layer 43 in the area framed by the ledge 32, but not saturate the area "w" where the ink cartridge 42 is fastened to the ledge 32. If the area between the ledge 32 and the ink storage layer 43 is saturated with ink, it will compromise the adhesive bond that retains the ink cartridge 42 to the ledge 32.

In the alternate embodiment as seen in FIGS. 6-9, an ink cartridge 60 is differently constructed as compared to the ink cartridge 42. The image forming layer 44 is the same as the previous embodiment. The ink storage layer 43 is also the same. However, there is an upstanding wall 62 that extends around the circumference of the cartridge 42. The upstanding wall 62 forms a "window frame" around the cartridge. Although illustrated as rectangular in cross section, the upstanding wall 62 can be any raised means that accomplishes the desired ends. The upstanding wall 62 is preferably made of the same ink absorbing material as the ink storage layer 43. In the embodiment illustrated in FIG. 7, the upstanding wall 62 is attached to the ink storage layer 43 by a thin layer of adhesive 64. The ink storage layer 43 is attached to the image forming layer 44 by means of adhesive 66.

The upstanding wall 62 creates an ink reservoir or ink well 68 inside of the ink cartridge 60. The top of the reservoir 68 is open, the upstanding wall 62 forms the sides, and the bottom is formed by the ink storage layer 43. On a top surface or edge 70 is an ink impermeable sealer 72. Any sealer that is impervious to the ink used is acceptable to provide the necessary barrier. For example if a petroleum based ink is used, the sealer 72 must be impervious to petroleum based inks. One such sealer is manufactured by Hirano Chemical Co., Ltd. Of Osaka, Japan and sold under the name H-Tack N40R which is an ethylene vinyl acetate copolymer. The purpose of the sealer is to provide an ink free surface so that the top surface 70 of the upstanding wall 62 can be adhesively attached to the ledge 32 of the frame 14. If ink is allowed to saturate the top surface 70, the adhesive bond between the top surface 70 and the ledge 32 will either not initially hold or will, over time, degrade to such as extent that the ink cartridge 60 will separate from the frame 14. This is not acceptable for hand stamps.

To use the ink cartridge 60, the user pours ink into the ink reservoir 68 until the ink is even with or just below the top surface 70. The ink is allowed to saturate the ink storage layer 43. In an alternative embodiment, an ink cartridge insert 74, having slightly smaller dimensions as the reservoir 68, is gently placed on top of the ink that is poured into the reservoir 68. The ink cartridge insert 74 is made of the same or similar ink absorbing material as the ink storage layer 43. The ink cartridge insert 74 absorbs ink providing additional storage material and provides structural support for the image forming layer 44 during stamping. Once the ink is absorbed into the ink storage layer 43, and the ink cartridge insert 74 if utilized, the cartridge 60 is attached by adhesive to the ledge 32. As previously stated, the adhesive can be tape or a layer of adhesive sprayed or poured on the sealer 72 on the top surface 70 or, alternatively, on the ledge 32.

Figure 9:
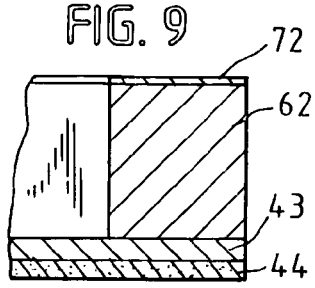
FIG. 9 is a cross section view of an alternate embodiment similar to FIG. 8 except not using an adhesive between the image forming layer and the ink storage layer.

FIG. 9 illustrates another alternative embodiment of the ink cartridge 60. Here the upstanding wall 62 is not adhesively bonded to the ink storage layer 43. Rather, it is merely placed on top of the ink storage layer 43.

Thus there has been provided a hand stamp that has a porous foam layer and ink cartridge mounted together and which has an ink absorbing wall around the perimeter of the ink cartridge that securely attaches to the stamp frame. The resultant hand stamp fully satisfies the objects and advantages set forth herein. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A hand stamp unit comprising:

an ink cartridge having an ink storage layer and an image forming layer, the image forming layer having an outer surface that is selectively sealable to form ink impermeable areas and ink permeable areas thereby creating an image, the ink cartridge having an outer edge and a border area adjacent to the outer edge on the ink storage layer, an upstanding wall in the border area having a top surface, sealing means on the top surface for inhibiting the flow of ink through the outer wall to the top surface for keeping the top surface ink free, an ink reservoir having an open top and a bottom formed by the ink storage layer and the upstanding wall, the ink storage layer forming the bottom of the ink reservoir and the open top surrounded by the upstanding wall, a frame member having a top, a bottom and side walls, a ledge on the frame member extending inward from the side walls, and an adhesive applied between the ledge and the upstanding wall for affixing the upstanding wall to the ledge.

2. The hand stamp unit of claim 1 wherein the sealing means is comprised of an ethylene vinyl acetate copolymer.

3. The hand stamp unit of claim 2 and further comprising a removable cover sheet that covers the adhesive until the ink cartridge is to be affixed to the ledge at which time it is removed thereby exposing the adhesive.

4. The hand stamp of claim 1 wherein the ink storage layer is oriented in a first plane and the upstanding wall is mounted to the ink storage layer and extends perpendicular to the first plane.

5. The hand stamp of claim 1 wherein the adhesive is a liquid adhesive applied to the ledge.

6. The hand stamp of claim 1 and further comprising an insert dimensioned to be received within the reservoir.

7. The hand stamp of claim 6 wherein the insert and the upstanding wall are made of the same material.

8. The hand stamp of claim 1 wherein the upstanding wall of the ink cartridge is made of porous material for absorbing and storing ink.

9. The hand stamp of claim 8 wherein the ink storage layer and the upstanding wall are made of the same material.

10. The hand stamp unit of claim 1 wherein the ink storage and image forming layers are bonded to each other.

11. A hand stamp unit comprising:

an ink cartridge having an ink storage layer and an image forming layer, the image forming layer forming an image to be printed, the ink cartridge having an outer edge and a border area adjacent to the outer edge on the ink storage layer, a frame member having a top, a bottom and side walls, a ledge on the frame member extending inward from the side walls, raised means completely surrounding the outer edge on the border area for forming an ink reservoir having an open top and a bottom with the ink storage layer forming the bottom and the open top surrounded by the raised means, a top surface on the raised means for providing an attachment surface between the raised means and the frame member, sealing means on the top surface for inhibiting the flow of ink through the raised means to the top surface for keeping the top surface ink free, and an adhesive applied between the ledge and the top surface for affixing the top surface to the ledge.

12. The hand stamp unit of claim 11 wherein the sealing means is comprised of an ethylene vinyl acetate copolymer.

13. The hand stamp unit of claim 12 and further comprising a removable cover sheet that covers the adhesive until the top surface is to be affixed to the ledge at which time it is removed thereby exposing the adhesive.

14. The hand stamp of claim 11 wherein the ink storage layer is oriented in a first plane and the raised means is mounted to the ink storage layer and extends perpendicular to the first plane.

15. The hand stamp of claim 11 and further comprising an insert dimensioned to be closely received within the ink reservoir.

16. The hand stamp of claim 15 wherein the insert and the raised means are made of the same material.

17. The hand stamp of claim 11 wherein the raised means is made of porous material for absorbing and storing ink.

18. The hand stamp of claim 17 wherein the ink storage layer and the raised means are made of the same material.

19. The hand stamp unit of claim 11 wherein the ink storage and image forming layers are bonded to each other.

* * * * *